US008943689B2

(12) United States Patent
Stiehler

(10) Patent No.: US 8,943,689 B2
(45) Date of Patent: Feb. 3, 2015

(54) METHOD FOR MOUNTING AN INTEGRAL INNER RING OF A TURBOCOMPRESSOR STATOR

(75) Inventor: Frank Stiehler, Bad Liebenwerda (DE)

(73) Assignee: MTU Aero Engines GmbH, Munich (DE)

( * ) Notice: Subject to any disclaimer, the term of this patent is extended or adjusted under 35 U.S.C. 154(b) by 529 days.

(21) Appl. No.: 13/143,358

(22) PCT Filed: Jan. 14, 2010

(86) PCT No.: PCT/DE2010/000023

§ 371 (c)(1),
(2), (4) Date: Jul. 6, 2011

(87) PCT Pub. No.: WO2010/081468

PCT Pub. Date: Jul. 22, 2010

(65) Prior Publication Data

US 2011/0265328 A1 Nov. 3, 2011

(30) Foreign Application Priority Data

Jan. 16, 2009 (DE) ..... 10 2009 004 934

(51) Int. Cl.

| | |
|---|---|
| ***B21K 25/00*** | (2006.01) |
| ***F01D 9/04*** | (2006.01) |
| ***F01D 17/16*** | (2006.01) |
| ***F01D 25/24*** | (2006.01) |

(52) U.S. Cl.

CPC ..... *F01D 9/042* (2013.01); *F01D 17/162* (2013.01); *F01D 25/246* (2013.01); *F01D 29/644* (2013.01)

USPC ..... 29/889.22

(58) Field of Classification Search

CPC ..... F01D 9/042; F01D 25/246; B23P 11/00; B23P 11/02; B23P 11/005

USPC ..... 29/889.22, 446, 447

See application file for complete search history.

(56) References Cited

U.S. PATENT DOCUMENTS

| | | | | |
|---|---|---|---|---|
| 3,156,970 | A | 11/1964 | Zojac | |
| 3,969,805 | A * | 7/1976 | Lievens et al. | 29/889.3 |
| 5,086,560 | A * | 2/1992 | Glazier | 29/898.061 |

FOREIGN PATENT DOCUMENTS

| | | | |
|---|---|---|---|
| BE | 669777 | A | 3/1966 |
| DE | 807572 | C | 7/1951 |
| DE | 892046 | C | 10/1953 |
| DE | 969599 | C | 6/1958 |
| DE | 1096921 | B | 1/1961 |
| DE | 1172900 | B | 6/1964 |
| DE | 1253956 | B | 11/1967 |
| DE | 2152365 | A1 | 8/1972 |
| EP | 1598524 | A1 | 11/2005 |
| FR | 1145011 | A | 10/1957 |
| FR | 1373359 | A | 9/1964 |
| GB | 865198 | | 4/1961 |

* cited by examiner

*Primary Examiner* — Moshe Wilensky
(74) *Attorney, Agent, or Firm* — Barlow, Josephs & Holmes, Ltd.

(57) ABSTRACT

A method for mounting an integral inner ring (10) of a turbocompressor stator to a guide vane ring (12) comprises the following steps: -Providing the guide vane ring (12) with an inner radius S; -Providing inner ring (10) with an outer radius R, which corresponds to the inner radius S; -Pre-tensioning inner ring (10) to an outer radius r that is smaller than the outer radius R of the untensioned inner ring (10); and -Relaxing inner ring (10) to the outer radius R.

21 Claims, 3 Drawing Sheets

METHOD FOR MOUNTING AN INTEGRAL INNER RING OF A TURBOCOMPRESSOR STATOR

BACKGROUND OF THE INVENTION

The invention relates to a method for mounting an integral inner ring of a turbocompressor stator to a guide vane ring.

In turbocompressors for gas turbines that have a stator with vanes, the guide vanes are mounted on a torsionally rigid inner ring. The inner ring is provided with openings (bearing depressions), into which the bearing bushes for the inner pins of the guide vanes can be inserted. The installation (mounting) of the inner ring is produced only when the guide vanes are inserted in the compressor housing. In the case of inner rings without axial partition, mounting has previously been possible only segmentally. The inner ring is divided into individual segments in the peripheral direction with a center angle of <180°, and the segments with the openings are individually "threaded" with the inner pins of the guide vanes, as long as the gap between the segments permits this. In practice, the segments thus usually have a center angle that is not greater than 30°.

Such a segmented inner ring is shown, for example, in EP 1 508 672 A1. A method for mounting a segmented inner ring without axial partition is known from DE 10 2006 024 085 A1. In the method described therein, the fact is exploited that the openings in the segments of the inner ring are clearly larger in diameter than the inner pins of the guide vanes, so that the latter can be positioned temporarily eccentrically and obliquely in the openings.

However, in comparison to one-part, closed (integral) inner rings, segmented inner rings have basic disadvantages. Thus, segmenting leads to a greater wear and a considerably shortened service life. Segmenting also leads to an undesired cluster vibrating.

BRIEF SUMMARY OF THE INVENTION

Up until now, however, no method is known by which an integral inner ring can be mounted satisfactorily without axial partition. The problem of the invention is to eliminate this deficiency and to indicate a method that makes possible a simple mounting and optionally a dismantling of an inner ring bearing guide vanes.

This problem is solved by a method of providing a guide vane ring with an inner radius S; providing the inner ring with an outer radius R, which corresponds to the inner radius S; pre-tensioning the inner ring to an outer radius r, which is constant over the periphery of the inner ring and which is smaller than the outer radius R of the untensioned inner ring; and unwinding the inner ring in the guide vane ring by relaxing the inner ring to the outer radius R. Advantageous and appropriate configurations of the method according to the invention are also described herein.

The method according to the invention for mounting an integral inner ring of a turbocompressor stator to a guide vane ring has the following steps:

- Providing the guide vane ring with an inner radius S;
- Providing the inner ring with an outer radius R, which corresponds to the inner radius S;
- Pre-tensioning the inner ring to an outer radius r, which is smaller than the outer radius R of the untensioned inner ring; and
- Relaxing of the inner ring to the outer radius R.

The invention is based on the knowledge that an integral inner ring can be made deformable so that with a suitable geometric design of its openings and of the inner pins of the guide vanes, the inner ring can be pre-tensioned so that if its tension is removed, the deforming motion of the inner ring can be utilized for threading of the inner ring into the guide vane ring.

The use of a die plate with a radius whose outer radius is smaller than the outer radius R of the untensioned inner ring minus its radial thickness is particularly advantageous. The die plate assures that an overextending of the inner ring does not occur, since it limits the bending to a defined radius.

BRIEF DESCRIPTION OF THE DRAWINGS

Additional features and advantages of the invention result from the following description and from the appended drawings, to which reference is made. Shown in the drawings are.

DETAILED DESCRIPTION OF THE INVENTION

Figure 1:
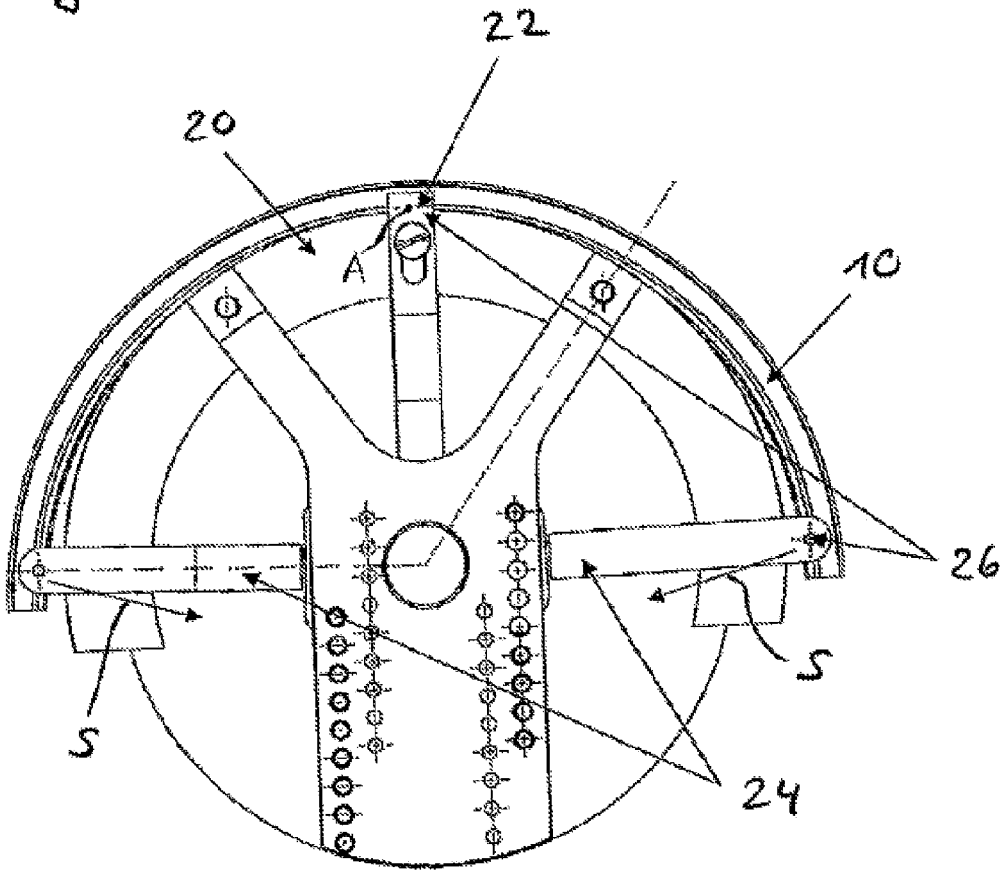
FIG. 1, a top view onto a die plate and a part of an inner ring before it is pre-bent.

The method according to the invention for mounting an integral inner ring of a turbocompressor stator to a guide vane ring is explained in more detail in the following, based on FIGS. 1 to 4.

First, an integral, i.e., undivided, one-piece inner ring 10 is provided with a constant outer radius R over its periphery. A one-piece partial ring with a center angle of ≥180° will also be understood here as a one-piece inner ring. The outer radius R of inner ring 10 corresponds to an inner radius S of a guide vane ring 12, to which inner ring 10 will be mounted.

Guide vane ring 12 is composed of all of guide vanes 14, or, as described in the following mounting process, of a portion of guide vanes 14 to be held by inner ring 10, which are already pre-mounted in the tube-shaped housing or in a housing part of the compressor. In the latter case, guide vane ring 12 is a partial ring (preferably with a center angle≈180°) of guide vanes 14 disposed next to one another in the peripheral direction. Guide vanes 14 have inner pins 16, which will be mounted in assigned openings 18 (bearing depressions) of inner ring 10.

Radii that are measured from the axial center axis of the compressor housing and that coincide in the mounted state of inner ring 10 are to be understood as the outer radius R of inner ring 10 and the inner radius S of guide vane ring 12. Concretely, these are half of the outer diameter of inner ring 10 and a radius in the region of inner pins 16 of guide vanes 14. (For reasons of simplicity in the drawings—with the exception of FIG. 4—the actual radii are not shown, but rather the arc lines belonging to them that are denoted R, S (and later r).

Inner ring 10 is pre-bent by means of a die plate 20 in the form of a disk or a disk-ring or a corresponding segment with an outer radius that is smaller than the outer radius R of inner ring 10 minus its radial thickness, by pre-tensioning inner ring 10 constantly to an outer radius r that is smaller than the outer radius R of inner ring 10 in the untensioned state. Pre-tensioning is produced over the entire periphery of inner ring 10 or over a specific portion, preferably over a portion whose arc length corresponds to the arc length of the pre-mounted guide vane ring 12 (referred to the radii R or S).

As is shown in FIG. 1, for this purpose, inner ring 10 is brought to an inner installation point A in the arrangement with die-plate 20. There, inner ring 10 is attached to a clamping piece 22 with an adjustable traction pin. In addition to this clamping piece 22, two other adjustable bracing units 24 are provided, with which the inner ring 10 is bent onto die plate 20 at two tension points that are diametrically opposite one another (center angle spacing of ≈180°. Bracing units 24 may have—according to the example shown in FIG. 1—pins 26 and/or clamps that form tension sites onto which a tensile force is introduced. The tensioning direction S is adjusted during the pre-tensioning in such a way that inner ring 10 does not bulge out, but is applied equally to die plate 20. Bracing units 22 and 24 are subsequently attached so that inner ring 10 remains in its pre-tensioned state.

Figure 2:
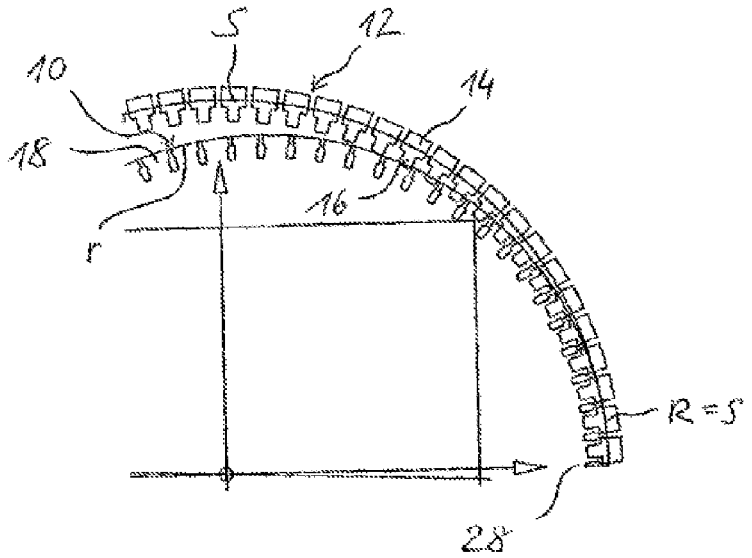
FIG. 2, a schematic partial section of a guide vane ring with inner ring attached on one side.
Figure 3:
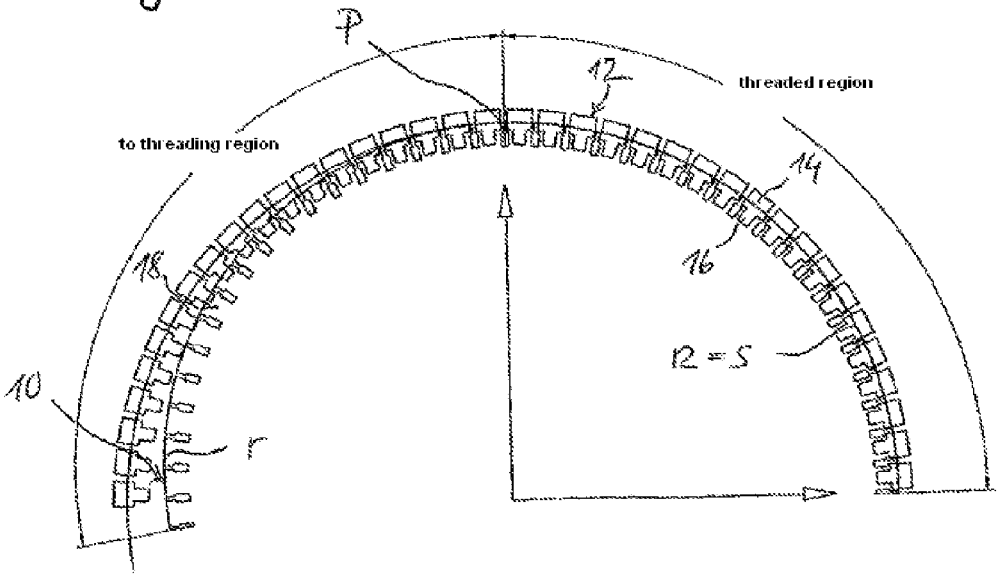
FIG. 3, a larger schematic partial section of the guide vane ring with partially threaded inner ring.

FIGS. 2 and 3 show schematically how subsequently inner ring 10 is threaded into the guide blade partial ring by relaxing to its initial outer radius R. The pre-tensioned inner ring 10 is placed at one end 28 of guide vane ring 12 and unwound in guide vane ring 12 by relaxing the adjustable bracing units 22 and 24 (loosening the attachment). In this way, openings 18 of inner ring 10 are moved without jamming over inner pins 16 of guide vanes 14. In the case of the special relaxation reshaping of inner ring 10 to its initial outer radius R, this is possible only due to the play of openings 18.

In FIG. 3, it is shown how the outer radius of the inner ring changes directly to the initial radius R (relaxed) at the tangential contact point P without transition from the smaller radius r (pre-tensioned). Thus, while the unwinding of inner ring 10 is produced continuously in guide vane ring 12, the radius of inner ring 10 executes a curvature jump from r to R at the revolving tangential contact point P.

The final operating position of inner ring 10, in which inner pins 16 and openings 18 are aligned, is thus achieved only with the utilization of the play in the bearing depression and the deviation between the tensioned and relaxed inner ring geometry.

Figure 4:
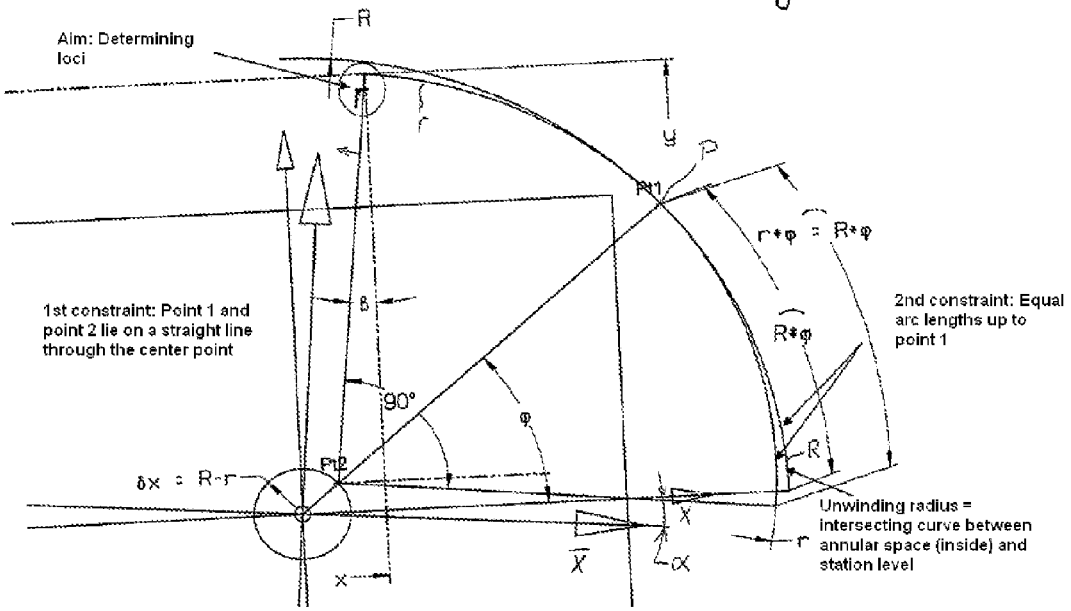
FIG. 4, the geometric model that is the basis for the method according to the invention.

The kinematic description of the unwinding procedure is derived from the model view according to FIG. 4. It results therefrom that the unwinding of inner ring 10 in the guide vane ring represents a hypocycloid movement, corresponding to the unwinding of a planet wheel in a gear ring. The movement path of a fixed point of inner ring 10 accordingly corresponds to a cycloid that was produced on an inner circle with the radius R-r (referred to the center axis of inner ring 10 or of guide vane ring 12).

The dismantling of inner ring 10 from guide vane ring 12 is possible by reversing the described mounting process, also without jamming.

The invention claimed is:

1. A method for mounting an integral inner ring of a turbocompressor stator to a guide vane ring having the following steps:

providing the guide vane ring with an inner radius S;

providing the inner ring with an outer radius R, which corresponds to the inner radius S;

pre-tensioning the inner ring to an outer radius r, which is constant over the periphery of the inner ring and which is smaller than the outer radius R of the untensioned inner ring; and unwinding the inner ring in the guide vane ring by relaxing the inner ring to the outer radius R;

wherein for pre-tensioning the inner ring, a die plate having a radius whose outer radius is smaller than the outer radius R of the untensioned inner ring minus its radial thickness is used.

2. The method according to claim 1, wherein the inner ring is brought to an inner installation point A in the arrangement with the die plate and is attached there to a clamping piece.

3. The method according to claim 1, wherein the pre-tensioning of the inner ring is carried out with the help of at least two bracing units that engage at traction points on the inner ring that preferably lie diametrically opposite one another.

4. The method according to claim 3, wherein the tensioning direction of the tensile forces introduced on the traction points is adjusted so that the inner ring does not bulge out and is applied equally to die plate.

5. The method according to claim 3, wherein for relaxing the inner ring, bracing units and optionally a traction pin coupled to a clamping piece are relaxed.

6. The method according to claim 1, wherein the outer radius R is half the outer diameter of the inner ring and the inner radius S is a radius measured from the axial center axis of a housing in the region of inner pins of guide vanes.

7. The method according to claim 1, wherein the guide vane ring is a partial ring, which comprises a portion of guide vanes with inner pins pre-mounted in a housing or part of a housing.

8. The method according to claim 7, wherein the guide vane ring has a center angle of approximately 180°.

9. The method according to claim 7, wherein the inner ring is pre-tensioned over an arc length referred to its radius R, which corresponds to the arc length of guide vane ring referred to its radius S.

10. The method according to claim 7, wherein when it is relaxed, the inner ring is placed at one end of guide vane ring and is unwound in guide vane ring so that the movement path of one fixed point of inner ring corresponds to a cycloid.

11. The method according to claim 10, wherein the cycloid is produced on an inner circle with radius R-r.

12. A method for mounting an integral inner ring of a turbocompressor stator to a guide vane ring having the following steps:

providing the guide vane ring with an inner radius S;

providing the inner ring with an outer radius R, which corresponds to the inner radius S;

pre-tensioning the inner ring to an outer radius r, which is constant over the periphery of the inner ring and which is smaller than the outer radius R of the untensioned inner ring; and unwinding the inner ring in the guide vane ring by relaxing the inner ring to the outer radius R;

wherein the guide vane ring is a partial ring, which comprises a portion of guide vanes with inner pins pre-mounted in a housing or part of a housing; and wherein when it is relaxed, the inner ring is placed at one end of guide vane ring and is unwound in guide vane ring so that the movement path of one fixed point of inner ring corresponds to a cycloid.

13. The method according to claim 12, wherein for pre-tensioning the inner ring, a die plate having a radius whose outer radius is smaller than the outer radius R of the untensioned inner ring minus its radial thickness is used.

14. The method according to claim 13, wherein the inner ring is brought to an inner installation point A in the arrangement with the die plate and is attached there to a clamping piece.

15. The method according to claim 13, wherein the pre-tensioning of the inner ring is carried out with the help of at least two bracing units that engage at traction points on the inner ring that preferably lie diametrically opposite one another.

16. The method according to claim 15, wherein the tensioning direction of the tensile forces introduced on the traction points is adjusted so that the inner ring does not bulge out and is applied equally to die plate.

17. The method according to claim 15, wherein for relaxing the inner ring, bracing units and optionally a traction pin coupled to a clamping piece are relaxed.

18. The method according to claim 12, wherein the outer radius R is half the outer diameter of the inner ring and the inner radius S is a radius measured from the axial center axis of a housing in the region of inner pins of guide vanes.

19. The method according to claim 12, wherein the guide vane ring has a center angle of approximately 180°.

20. The method according to claim 12, wherein the inner ring is pre-tensioned over an arc length referred to its radius R, which corresponds to the arc length of guide vane ring referred to its radius S.

21. The method according to claim 12, wherein the cycloid is produced on an inner circle with radius R-r.

* * * * *